US007357626B2

(12) United States Patent
Kang et al.

(10) Patent No.: US 7,357,626 B2
(45) Date of Patent: Apr. 15, 2008

(54) SUCTION VALVE FOR RECIPROCATING COMPRESSOR

(75) Inventors: Kyung-Seok Kang, Kimhae (KR); Seong-Yeol Hyeon, Changwon (KR); Sung-Tae Woo, Busan (KR)

(73) Assignee: LG Electronics, Inc. (KR)

( * ) Notice: Subject to any disclaimer, the term of this patent is extended or adjusted under 35 U.S.C. 154(b) by 651 days.

(21) Appl. No.: 10/479,777

(22) PCT Filed: May 25, 2001

(86) PCT No.: PCT/KR01/00881

§ 371 (c)(1),
(2), (4) Date: Nov. 24, 2003

(87) PCT Pub. No.: WO02/095233

PCT Pub. Date: Nov. 28, 2002

(65) Prior Publication Data

US 2004/0146418 A1 Jul. 29, 2004

(51) Int. Cl.
*F04B 39/10* (2006.01)
*F04B 53/12* (2006.01)

(52) U.S. Cl. ..... 417/549; 417/550; 417/551

(58) Field of Classification Search ..... 417/549, 417/550, 551

See application file for complete search history.

(56) References Cited

U.S. PATENT DOCUMENTS 4,862,911 A * 9/1989 Yie ..... 137/454.4
5,163,819 A * 11/1992 Pettitt ..... 417/269
6,152,703 A * 11/2000 Yoshimura et al. ..... 417/312
6,585,500 B2 * 7/2003 Park et al. ..... 417/549

FOREIGN PATENT DOCUMENTS

| | | |
|---|---|---|
| EP | 0 554 927 A1 | 1/1993 |
| JP | 53012606 | 2/1978 |
| JP | 61122387 | 8/1986 |

(Continued)

OTHER PUBLICATIONS

Untranslated Office Action issued by the Japanese Patent Office on Oct. 31, 2006 in connection with corresponding Japanese application No. 2002-591671.

(Continued)

*Primary Examiner*—Devon C. Kramer
*Assistant Examiner*—Patrick Hamo
(74) *Attorney, Agent, or Firm*—Ostrolenk, Faber, Gerb & Soffen, LLP

(57) ABSTRACT

A suction valve for reciprocating compressor includes a fixation part, which receives a driving force of a reciprocating motor, and is fixed-combined to the front end surface of a piston performing linear reciprocal movement in the cylinder, a switching part for switching a hollow channel formed to penetrate the piston having a certain area, and a plurality of arms for connecting the switching part and the fixation part to make the switching unit behave in a certain displacement section having the fixation part as a fixed point. Receiving driving force of the reciprocating motor, the piston is bent and straighten by the pressure difference, and stress is distributed evenly in the above process, and minimizing bulking phenomenon to prevent damage of a switching part. Also, the responsiveness of the valve can be improved.

11 Claims, 6 Drawing Sheets

FOREIGN PATENT DOCUMENTS

| | | |
|---|---|---|
| JP | 1127980 | 8/1989 |
| JP | 5039781 | 2/1993 |
| JP | 5021185 | 3/1993 |
| JP | 09-137778 | 5/1997 |
| JP | 2002054571 | 2/2002 |
| JP | 2002054572 | 2/2002 |
| KR | 1999-010738 | 3/1999 |

OTHER PUBLICATIONS

Untranslated Office Action issued by the Chinese Patent Office on Aug. 26, 2005 in connection with corresponding Chinese application No. 01823413.5.

English translation of relevant portions of Chinese Patent Office Action issued Aug. 26, 2005 submitted in lieu of statement of relevancy of prior art teachings to the instant application.

* cited by examiner

SUCTION VALVE FOR RECIPROCATING COMPRESSOR

TECHNICAL FIELD

The present invention relates to a suction valve of a reciprocating compressor and particularly, to a suction valve of a reciprocating compressor, capable of evenly distributing a stress which is generated in the process of opening and closing a gas flow path in which gas flows without being concentrated in a location and improving responsiveness.

BACKGROUND ART

Generally, a compressor is a device for compressing fluid. The compressor is divided into a rotary compressor, a scroll compressor and a reciprocating compressor according to compressing methods.

The reciprocating compressor includes a motor unit for generating a linear reciprocating driving force and a compression unit for receiving the driving force of the motor unit and compressing gas.

In the reciprocating compressor, as a current is applied to the motor unit, the linear reciprocating driving force generated at the motor unit is transmitted to the compression unit, thereby sucking, compressing, and discharging refrigerant in the compression unit.

FIG. 1 is a view illustrating one example of the compression unit of the reciprocating compressor. As shown in FIG. 1, the compression unit of the reciprocating compressor includes a cylinder 10 provided with a through hole 11 therein which makes a compression space P therein; a piston 20 inserted to the through hole 11 of the cylinder 10 for a linear movement and provided with a hollow channel F therein; and a discharge valve assembly 30 engaged to an end portion of the cylinder 10 for covering the through hole 11.

The piston 20 includes a head portion at one side of a body portion 21 having a predetermined length, and a connecting portion 23 connected to the motor unit at the other side of the body portion 21.

Also, the piston 20 is provided with a hollow channel F formed to penetrate the piston 20 for making the refrigerant flow, and the hollow channel F includes a gas passage 24 having a predetermined depth at a center of the body portion 21 and a suction hole 25 penetrating the head portion 22 to be connected to the gas passage 24.

Also, a suction valve 40 is mounted at a front end surface S of the piston head portion 22 for controlling the refrigerant flowing to the hollow channel F by opening and closing the suction hole 25.

The discharge valve assembly 30 includes a discharge cover 31 engaged to cover an end portion of the cylinder 10, a discharge valve 32 inserted in the discharge cover for opening and closing a compression space P formed by the piston 20 and a through hole of the cylinder 10, and a valve spring 33 for elastically supporting the discharge valve 32.

In the compression unit of the reciprocating compressor, a linear driving force of the motor unit is transmitted to the piston 20, so that the piston 20 has a linear reciprocation in the cylinder 10.

In said process, as shown in FIG. 2, if the piston 20 moves towards a lower dead point a, the discharge valve 32 is in contact to the end portion of the cylinder 10 by a pressure difference to close the compression space P, and the suction valve 40 engaged to the piston 20 is bent to open the suction hole 25. According to this, refrigerant flows through the hollow channel F of the piston 20 and is sucked to the compression space P of the cylinder 10.

Then, if the piston 20 moves from the lower dead point a to an upper dead point b, the suction valve 40 is straightened by a pressure difference as it was, and compresses the refrigerant sucked in the compression space P of the cylinder 10 under a state that the suction hole 25 of the hollow channel is blocked. Subsequently, if the piston 20 reaches to the upper dead point b, the discharge valve 32 is opened, thereby discharging the compressed refrigerant. The said process is continuously repeated to compress gas.

In the meantime, the suction valve 40 mounted to the front end portion S of the piston 20 for opening and closing the hollow channel F by repeating curving and straightening by a pressure difference due to a movement of the piston 20 should have an excellent responsiveness of a valve to suck and compress the refrigerant, and should minimize a stress concentration to prevent damage.

As an example of the suction valve 40 of the reciprocating compressor currently being developed, as shown in FIG. 3, the suction valve 30 formed as a thin circle plate corresponding to the front end portion S of the head portion 22 of the piston includes a fixation point 41 formed at the center of the circle plate and a cut off C having a predetermined width in the circle plate as an opened curved line to bend a part of the circle plate on the basis of the fixation point 41.

The cut off C of the opened curved line includes an inner circular curved line portion makes a circle form to surround the fixation point 41, and an outer circular curved line portion 43 prolonged from the inner circular curved line portion 42 and to be opened outwardly.

The suction valve is composed of a fixation part 44 corresponding to the fixation point 41 side by the inner circular curved line portion 42 and the outer circular curved line portion 43, and an open/close part 45 of the opposite side of the fixation part 44.

The open/close part 45 has a cantilever shape and a width thereof becomes narrower towards an inner end portion of the inner circular curved line portion 42.

Under a state that the open/close part 45 of the suction valve 40 is located at an end surface of the piston 20 to block the hollow channel F of the piston 20, the fixation point 41 thereof is welded to the front end surface S of the piston and fixed-engaged to the piston 20.

The engaged suction valve 40 opens and closed the hollow channel F by the open/close part 45 which is bent and straightened under a state that the fixation point 41 is fixed by a pressure difference as the piston 20 reciprocates.

However, in the process that the open/close part 45 is bent and straightened, since the open/close part 45 of the suction valve for opening and closing the hollow channel F of the piston 20 is formed as a cantilever form, as shown in FIG. 4, a stress is concentrated to a neck portion of the open/close part 45, that is, an inner end portion of the cut off C for forming the open/close part 45. According to this, when the opening and closing operations are continuously performed or the open/close part 45 is opened, the valve is destroyed.

TECHNICAL GIST OF THE PRESENT INVENTION

Therefore, an object of the present invention is to provide a suction valve of a reciprocating compressor capable of evenly distributing a stress generated in the process of opening and closing a gas flow path in which gas flows without being concentrated in a location and improving responsiveness.

DETAILED DESCRIPTION OF THE INVENTION

In order to achieve the above objects, there is provided a suction valve of a reciprocating compressor including a fixation part, which receives a driving force of a reciprocating motor, and is fixed-combined to the front end surface of a piston performing a linear reciprocal movement in the cylinder; an open/close part for opening and closing a hollow channel formed to penetrate the piston having a certain area, and a plurality of arms for connecting the open/close part and the fixation part to make the open/close part behave in a certain displacement section by having the fixation part as a fixed point.

MODE FOR CARRYING OUT THE PREFERRED EMBODIMENTS

The present invention will now be described with reference to accompanying drawings.

First, the reciprocating compressor includes a motor unit for generating a linear reciprocating driving force, and a compression unit for receiving the driving force of the motor unit and compressing gas, wherein the motor unit is made of a reciprocating motor.

Figure 1:
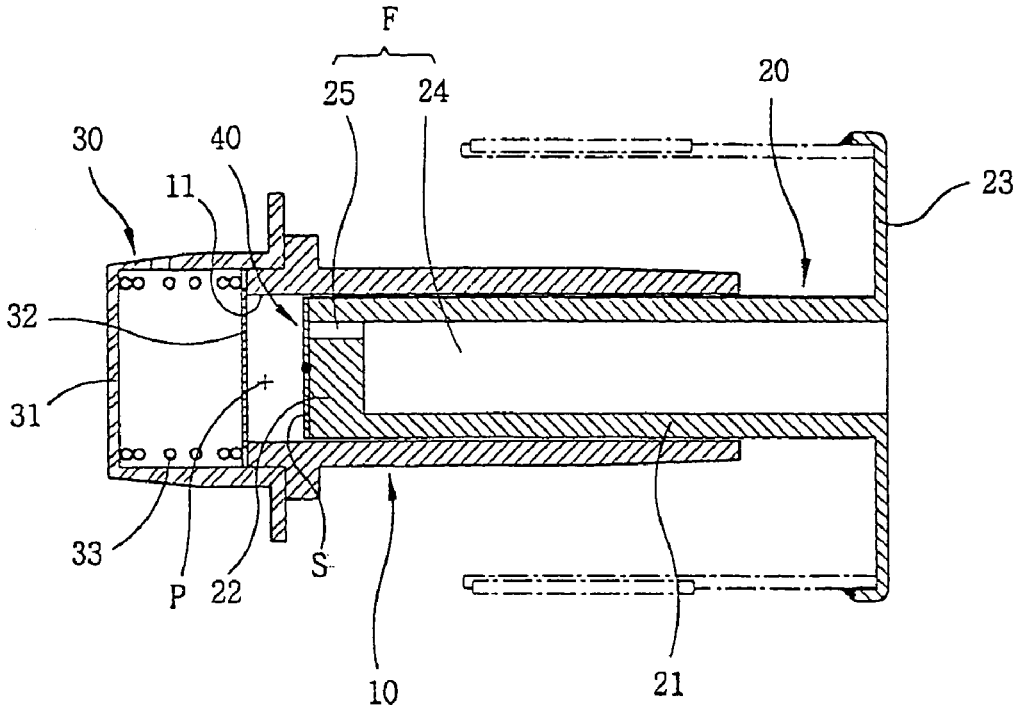
FIG. 1 is a cross-sectional view showing a compression unit of a reciprocating compressor.
Figure 2:
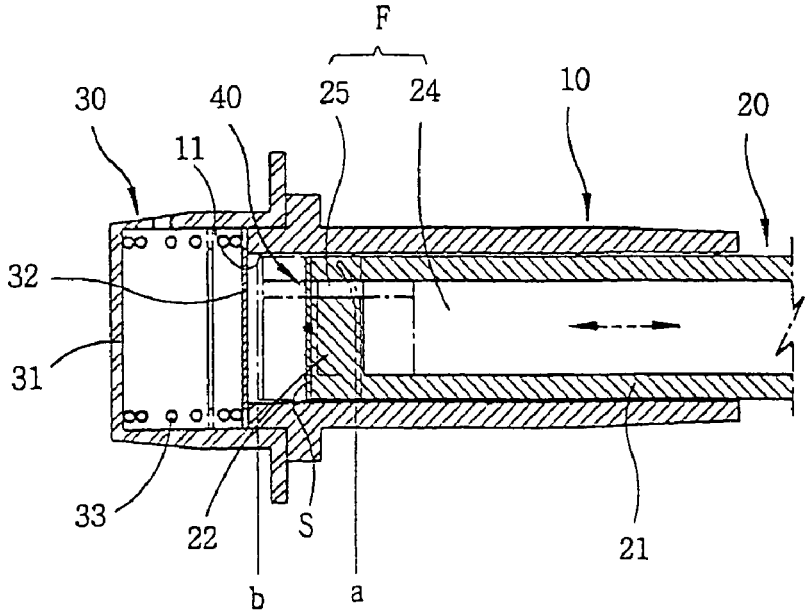
FIG. 2 is a cross-sectional view showing an operation state of the compression unit of the reciprocating compressor.
Figure 3:
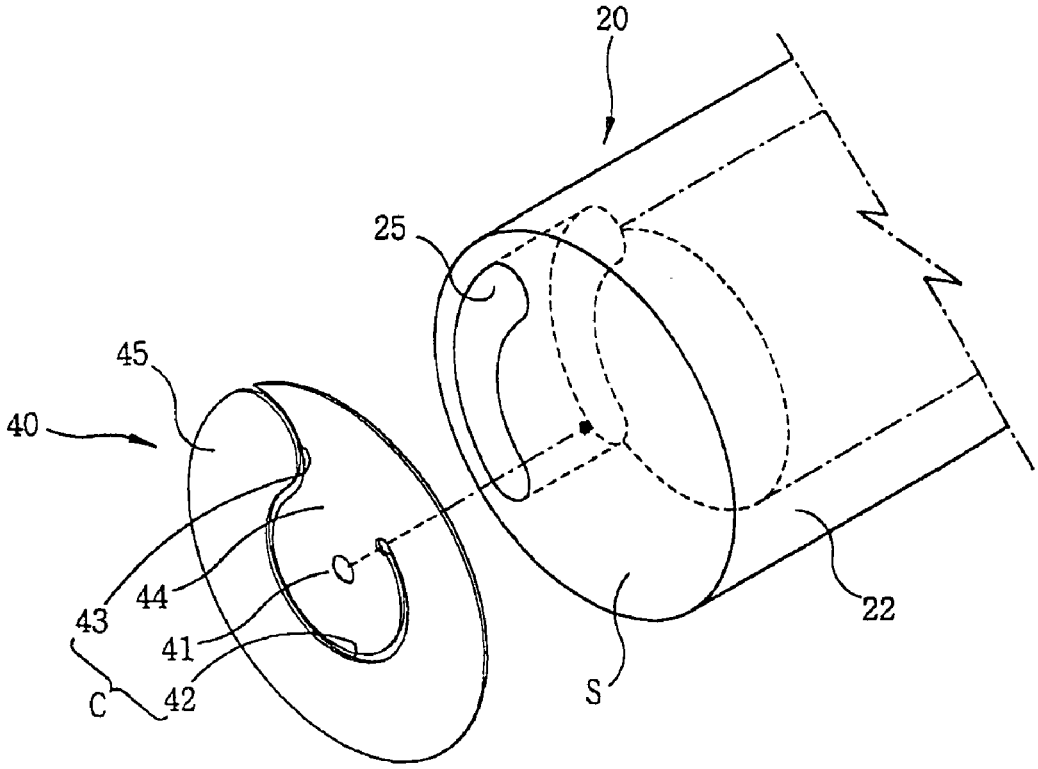
FIG. 3 is a perspective view showing a suction valve of a reciprocating compressor which is currently developed.
Figure 4:
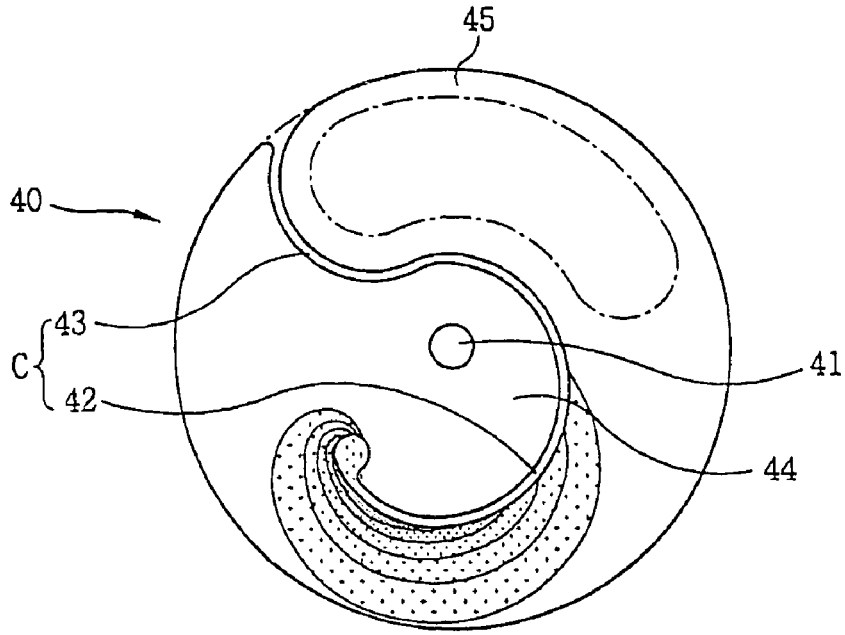
FIG. 4 is a front view showing a stress distribution state of a suction value of the above reciprocating compressor.
Figure 5:
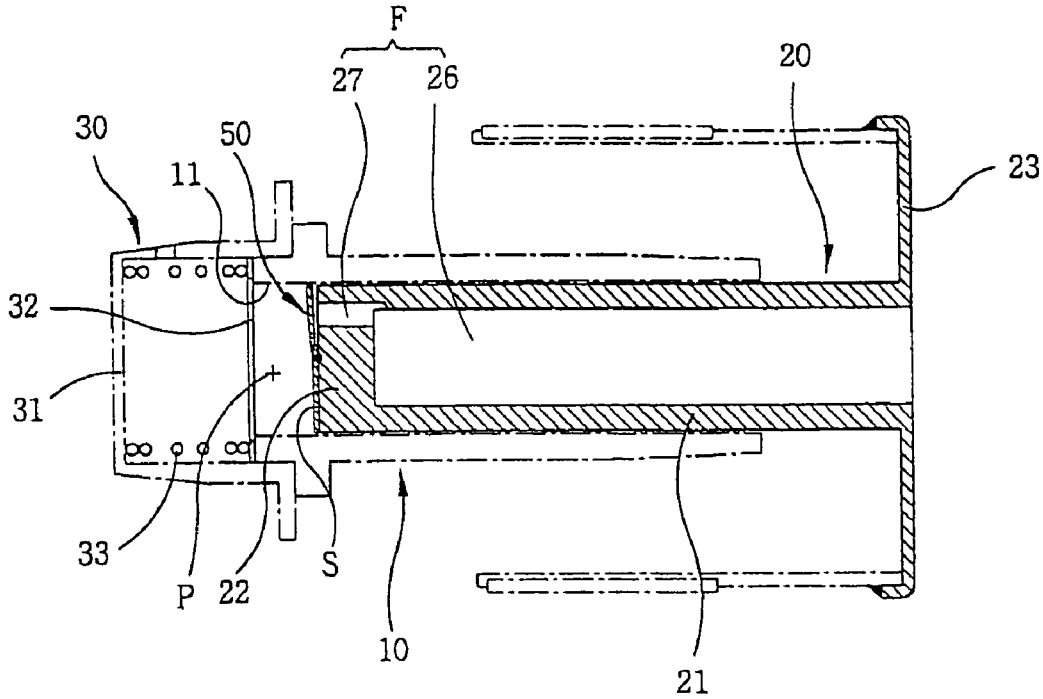
FIG. 5 is a cross-sectional view showing a compression unit in which the suction valve of a reciprocating compressor in accordance with the present invention is provided.

FIG. 5 is a cross-sectional view showing a compression unit in which the suction valve of a reciprocating compressor in accordance with the present invention is provided. As shown in FIG. 5, the compression unit includes a cylinder 10 provided with a through hole 11 therein, the through hole making a compression space P therein; a piston 20 inserted to the through hole 11 of the cylinder 10 to have a linear movement and provided with a hollow channel F therein; and a discharge valve assembly 30 engaged to an end portion of the cylinder 10 to cover the through hole 11 for opening and closing the through hole 11.

The compression space P is formed by the through hole 11, the piston 20, and the discharge valve assembly 30 of the cylinder.

The piston 20 includes a head portion at one side of a body portion 21 having a predetermined length, and a connecting portion 23 connected to the motor unit at the other side of the body portion 21.

Also, the piston 20 is provided with a hollow channel F penetrating the piston 20 for making the refrigerant flow, and the hollow channel F includes a gas passage 26 having a predetermined depth at a center of the body portion 21 and a suction hole 27 penetrating the head portion 22 to be connected to the gas passage 26.

Also, a suction valve 50 of a thin plate is mounted at a front end surface S of the piston head portion 22 for opening and closing the suction hole 27 of the hollow channel F.

Figure 6:
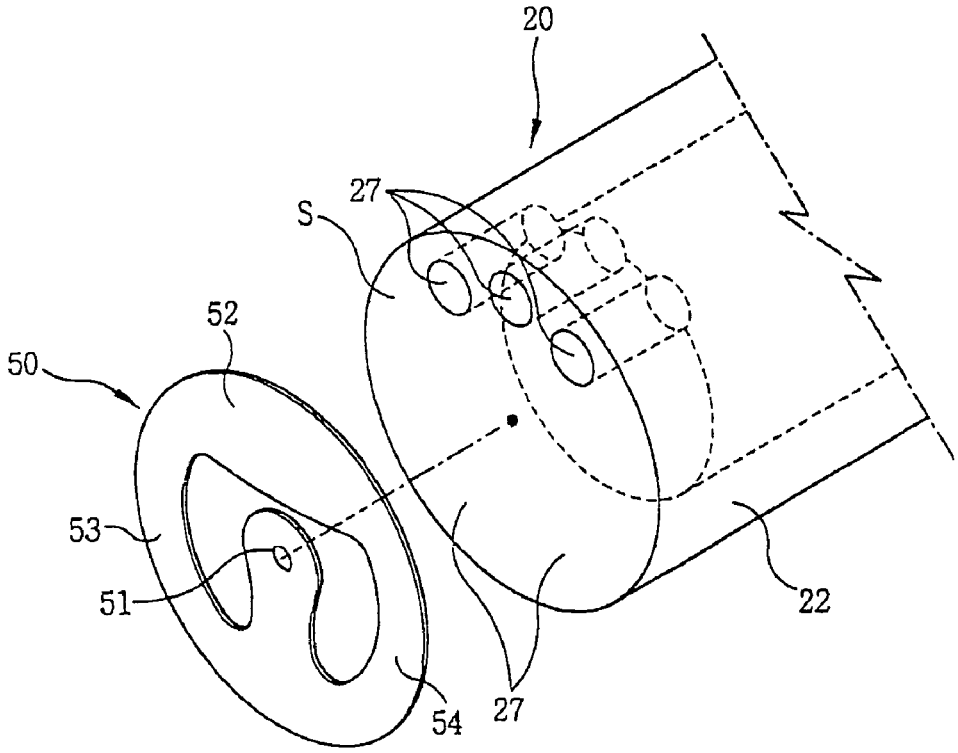
FIG. 6 is a perspective view showing the suction valve and a piston head portion of the reciprocating compressor in accordance with the present invention.

The discharge valve 50, as shown in FIG. 6, a fixation part 51 having a predetermined area and engaged to a front end portion S of the piston; a open/close part 52 having a predetermined area and penetrating the piston 20 for opening and closing the hollow channel; and a plurality of arms 53 and 54 for connecting the open/close part 52 and the fixation part 51 and making the open/close part 52 move in a predetermined displacement section by having the fixation part 51 as a fixation point.

The arms 53 and 54 are formed symmetrically on the basis of a connection line between a center of the fixation part 51 and a center of the open/close part 52.

That is, the fixation part 51 having a circular area is formed, and the first and second arms 53 and 54 having a circular arc shape having a predetermined width and length are respectively prolonged towards both sides of the fixation part 51, then, the open/close part 52 having a predetermined area is formed.

A width of the first and second arms 53 and 54 can be formed uniformly or differently. That is, the width of the first and second arms can be wide towards the open/close part 52 or narrow.

The fixation part 51, the first and second arms 53 and 54, and an outer surface of the open/close part 52 make a circular shape, and an outer diameter of the circular shape is smaller than that of the front end surface of the piston 20.

Also, the fixation part 51, the first and second arms 53 and 54, and an inner surface of the open/close part 52 make a close space. The fixation part 51 is engaged to the front end portion S of the piston 20 by bolting or welding.

Figure 7:
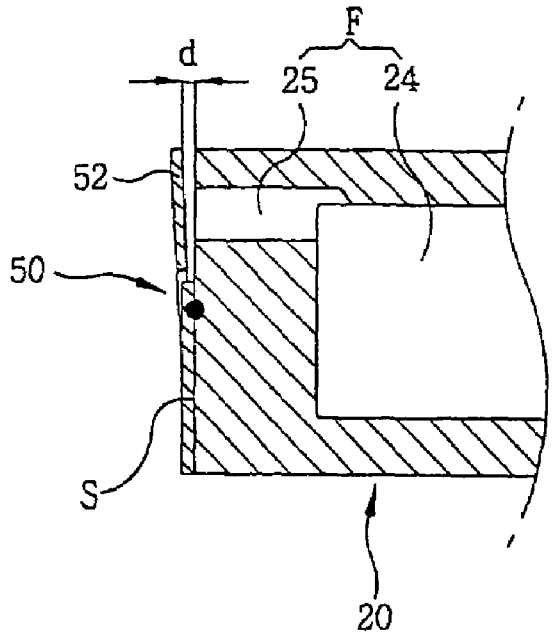
FIG. 7 is a front view showing a modification example of the suction valve of the reciprocating compressor in accordance with the present invention.

The open/close part 52 and the plurality of arms 53 and 54, as shown in FIG. 7, are formed to have an initial displacement by being bent from the front end portion S of the piston 20 to a front end portion of the cylinder 10 with a predetermined amount.

The fixation part 51 of the suction valve 50 engaged to the front end portion S of the piston 20 is preferably engaged by being located to a center of the front end portion S of the piston 20.

The suction holes 27 formed at the head portion of the piston 20 are plural, and the open/close part 52 of the suction valve 50 is formed to have an area to block the plurality of suction holes 27.

That is, the hollow channel F includes the gas passage 26 formed at the body portion of the piston, and the plurality of suction holes 27 penetrating the head portion 22 of the piston 20. Three suction holes 27 are shown in the drawings.

Figure 8:
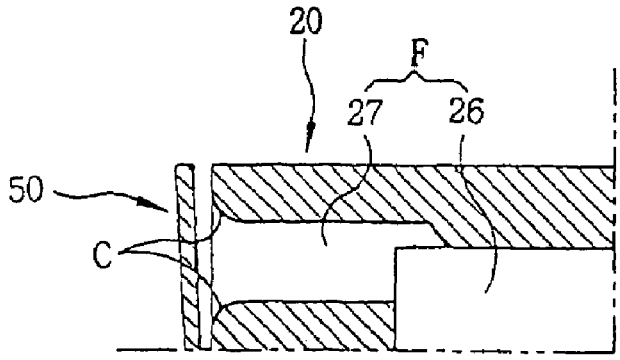
FIG. 8 is a front view showing a modification example of the suction valve of the reciprocating compressor in accordance with the present invention.

Also, as shown in FIG. 8, an edge of the suction hole 27 is preferably fillet (C) by rounding. As an example of its modification, the edge of the suction hole 27 can be chamfered as a straight line.

Figure 9:
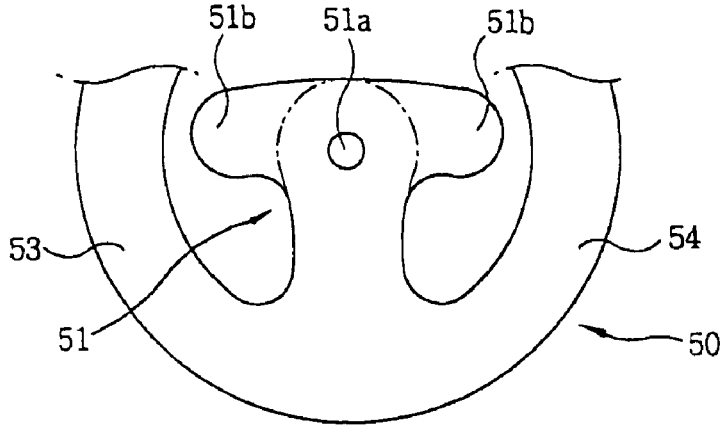
FIG. 9 is a front view showing a modification example of the suction valve of the reciprocating compressor in accordance with the present invention.

A modification example of the fixation part 51, as shown in FIG. 9, includes a fixation surface 51*a* having a predetermined area and fixed by bolting or welding, and a protruded portion 51*b* extended from the fixation surface 51*a* with a predetermined area and located at a space formed by the plurality of arms 53 and 54

Figure 10:
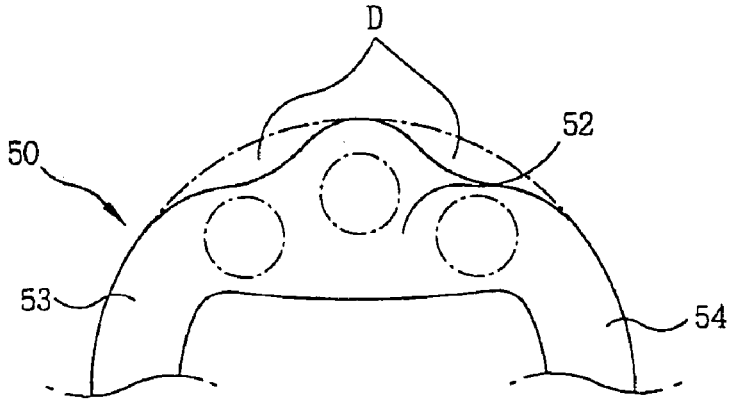
FIG. 10 is a front view showing a modification example of the suction valve of the reciprocating compressor in accordance with the present invention.

A modification example of the open/close part 52, as shown in FIG. 10, includes a cutting portion D cut off at an outer portion of the suction valve according to a shape of the suction hole 27 of the hollow channel F formed at the front end surface S of the piston 20.

Figure 11:
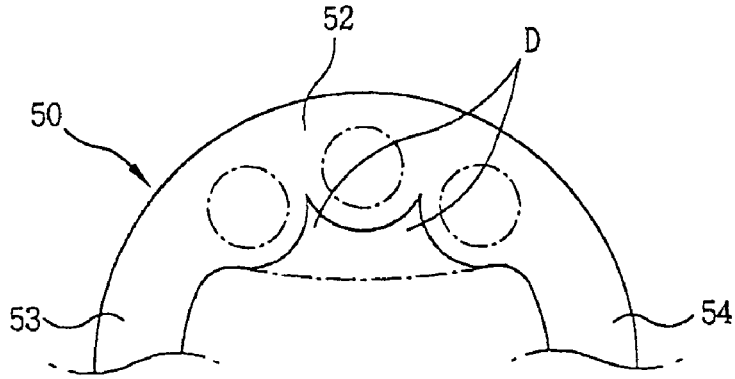
FIG. 11 is a front view showing a modification example of the suction valve of the reciprocating compressor in accordance with the present invention.

Another modification of the open/close part 52, as shown in FIG. 11, includes a cutting portion D cut off at an inner portion of the suction valve according to a shape of the suction hole 27 of the hollow channel F formed at the front end surface S of the piston 20.

Figure 12:
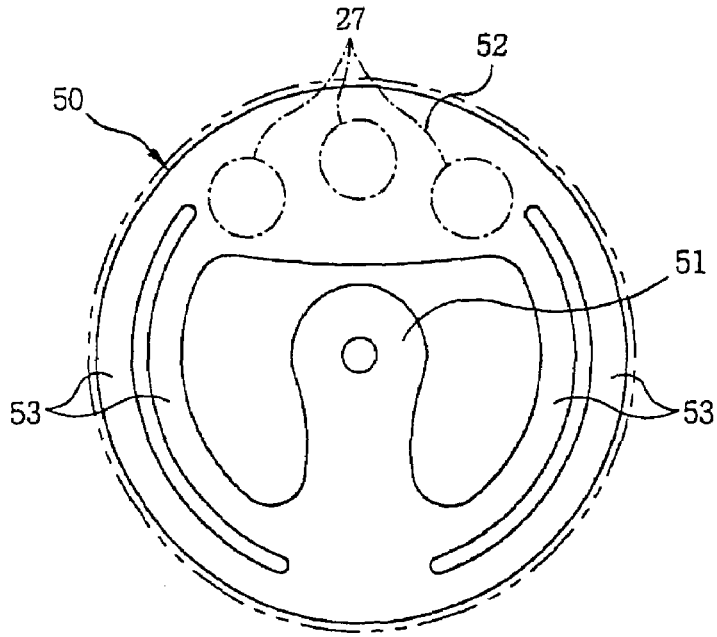
FIG. 12 is a front view respectively showing the other modification example of the suction valve of the reciprocating compressor in accordance with the present invention.

As another embodiment of the present invention, as shown in FIG. 12, the suction valve includes a fixation part 51 engaged to the front end portion S of the piston 20; a open/close part 52 having a predetermined area for opening and closing a hollow channel F penetrating the piston 20; and four arms 53 for connecting the open/close part 52 and the fixation part 51 and making the open/close part 52 move in a predetermined displacement section by having the fixation part 51 as a fixation point.

Figure 13:
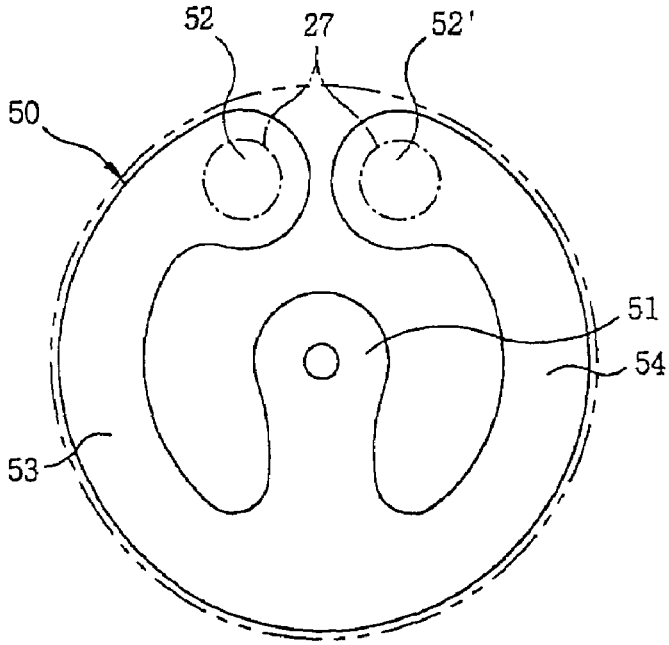
FIG. 13 is a front view respectively showing the other modification example of the suction valve of the reciprocating compressor in accordance with the present invention.

As another embodiment of the present invention, as shown in FIG. 13, the suction valve includes two open/close parts 52 and 52' located at the front end portion S of the piston 20 provided with two gas suction holes 27 for opening the two suction holes 27; and two arms 53 and 54 for connecting the fixation part 51 engaged to the front end portion S of the piston 20 and the two open/close parts 52 respectively.

An unexplained code 30 denotes a discharge valve assembly, 31 denotes a discharge cover, 32 denotes a discharge valve, and 33 denotes a valve spring.

Hereinafter, operations and effects of the suction valve of a reciprocating compressor in accordance with the present invention will be explained.

First, if the piston 20 receives a driving force of the motor unit and reciprocates linearly in the cylinder 10, the suction valve 5 engaged to an end portion of the piston 20 is bent and straightened repeatedly by a pressure difference. According to this, refrigerant is sucked, compressed, and discharged repeatedly through the hollow channel F of the piston 20, that is, the gas passage 26 and the suction hole 27.

In said process, in case that the suction valve 50 opens the suction 27 of the hollow channel F formed at the front end portion S of the piston 20 by a pressure difference, the plurality of arms 53 and 54 and the open/close part 52 are bent by being fixed by the fixation part 51 of the suction valve 50, thereby opening the suction hole 27.

Also, in case that the suction valve 50 closes the suction 27 of the hollow channel F formed at the front end portion S of the piston 20 by a pressure difference, the plurality of arms 53 and 54 and the open/close part 52 are straightened by being fixed by the fixation part 51 of the suction valve 50, thereby closing the suction hole 27.

In the meantime, as the plurality of arms 53 and 54 having a cantilever shape are bent and straightened under a state that the suction valve 50 is fixed by the fixation part 51, a stress occurs. At this time, the stress is distributed to the plurality of arms 53 and 54 evenly, so that the stress is not excessively concentrated to one conventional arm. Also, the plurality of arms 53 and 54 are formed symmetrically, thereby distributing the stress more evenly.

Also, since the open/close part 52 of the suction valve 50 and the plurality of arms 53 and 54 have a predetermined displacement with the end portion surface S of the piston 20, the suction hole 27 is opened and closed more smoothly. That is, responsiveness of the valve is improved.

Also, since the fixation part 51 of the suction valve 50 provided with the fixation surface 51*a* and the protruded portion 51*b* reduces the inner space, a dead volume of the compression space is reduced, thereby enhancing a compression performance.

Also, the suction holes 27 of the piston 20 opened and closed by the suction valve 50 are plural, a bulking phenomenon is prevented, thereby preventing damage of the valve.

The bulking is a phenomenon that the open/close part 52 of the suction valve 50 is sucked to an inner side of the piston by the suction hole 27 of the piston 20 when a great pressure is added to the suction valve 50 as the piston 20 reaches to the upper dead point in a process of the compression.

Also, since the suction holes 27 are formed with a plurality of small holes, an amount that the suction valve 50 is modified by a pressure is less than when the suction holes 27 are formed with one large hole, thereby preventing damage of the suction valve 50.

Besides, since the edge of the suction holes 27 is chamfered, the suction valve 50 is prevented from being damaged by the edge of the suction holes 27 at the time of the bulking phenomenon.

Also, since the open/close part 52 of the suction valve is cut off at an outer portion thereof according to a shape of the suction holes 27, a gap is obtained at the compression space P of the cylinder, that is, between the inner circumference surface of the cylinder through hole and the open/close part 52 of the suction valve 50. According to this, refrigerant is smoothly sucked to the compression space P even in case that the valve is opened, thereby increasing a suction amount of the refrigerant.

INDUSTRIAL APPLICABILITY

As so far described, the suction valve of the reciprocating compressor of the present invention is bent and straightened by a pressure difference as the piston receives a driving force of the reciprocating motor and linearly reciprocates in the cylinder, thereby sucking refrigerant gas. In said process, a stress generated at the valve is evenly distributed and the bulking phenomenon is minimized, so that a damage is prevented to enhance reliability. Also, responsiveness of the valve becomes excellent and the refrigerant is smoothly sucked to the compression space of the cylinder, thereby enhancing a compression performance of the refrigerant.

The invention claimed is:

1. A suction valve for a reciprocating compressor, comprising:

a fixation part which receives a driving force of a reciprocating motor and is engaged to a front end surface of a piston performing a linear reciprocation in the cylinder;

an open/close part having a predetermined area for opening and closing a hollow channel formed to penetrate the piston; and a plurality of arms for connecting the open/close part and the fixation part and making the open/close part move in a certain displacement section by having the fixation part as a fixed point, in which a stress generated by a movement of the open/close part is distributed to the plurality of arms, wherein the fixation part extends in a direction radially away from the open/close part and is connected to the plurality of arms at an end portion thereof opposite the open/close part, and wherein the plurality of arms, and an outer surface of the open/close part form a circular shape.

2. The valve of claim 1, wherein the arms are composed of two.

3. The valve of claim 2, wherein the two arms are symmetrical to each other on the basis of a connection line which connects a center of the fixation part and a center of the open/close part.

4. The valve of claim 1, wherein the fixation part includes:

a fixation surface having a predetermined area and fixed by bolting or welding; and a protruded portion extended from the fixation surface with a predetermined area and located at a space formed by the plurality of arms.

5. The valve of claim 1, wherein the suction holes formed at a front end portion of the piston for forming a part of the hollow channel and opened and closed by the open/close part are plural.

6. The valve of claim 5, wherein an edge of the suction hole is filleted by a rounding or chamfered by a straight line.

7. The valve of claim 1, wherein the open/close part is cut off at an outer portion according to a shape of the suction hole of the hollow channel formed at the front end portion of the piston.

8. The valve of claim 1, wherein an outer diameter formed by the open/close part, the fixation part, and the arms is smaller than that of the front end portion of the piston.

9. The valve of claim 1, wherein the open/close part and the plurality of arms are formed to have an initial displacement by being bent from the front end portion of the piston to a front end portion of the cylinder with a predetermined amount.

10. The valve of claim 1, wherein the fixation part is located at a center of the front end portion of the piston.

11. A suction valve of a reciprocating compressor, in the reciprocating compressor attached to an upper surface of a piston which reciprocates by a reciprocating motor for controlling gas sucked through a hollow channel in the piston, the suction valve comprising:

a piston having a plurality of gas suction holes;

at least one open/close part fixed to an upper end portion of the piston for corresponding to the gas suction holes;

a fixation part engaged to the piston; and one or plural arms for connecting the one or plural open/close parts to the fixation part, wherein the fixation part extends in a direction radially away from the open/close part and is connected to the plurality of arms an end portion thereof opposite the open/close part, and wherein the plurality of arms, and an outer surface of the open/close part form a circular shape.

* * * * *